US007663324B2

(12) United States Patent
Tran et al.

(10) Patent No.: US 7,663,324 B2
(45) Date of Patent: Feb. 16, 2010

(54) CONTROL CIRCUIT AND METHOD FOR DRIVING A GAS DISCHARGE LAMP

(75) Inventors: Trong Tran, Erlangen (DE); Andreas Kraus, Neuhaus (DE)

(73) Assignee: Diehl Aerospace GmbH, Uberlingen (DE)

( * ) Notice: Subject to any disclaimer, the term of this patent is extended or adjusted under 35 U.S.C. 154(b) by 518 days.

(21) Appl. No.: 11/603,694

(22) Filed: Nov. 23, 2006

(65) Prior Publication Data

US 2007/0120501 A1 May 31, 2007

(30) Foreign Application Priority Data

Nov. 25, 2005 (DE) ..... 10 2005 056 229

(51) Int. Cl.
*H05B 37/02* (2006.01)

(52) U.S. Cl. ..... 315/291; 315/209 R; 315/307

(58) Field of Classification Search ..... 315/209 R, 315/224, 225, 242–244, 273, 276, 291, 307, 315/361, 362, DIG. 5
See application file for complete search history.

(56) References Cited

U.S. PATENT DOCUMENTS 5,345,148 A * 9/1994 Zeng et al. ..... 315/209 R
5,416,387 A * 5/1995 Cuk et al. ..... 315/209 R
5,446,366 A * 8/1995 Bassett et al. ..... 323/222
5,962,985 A * 10/1999 Buij et al. ..... 315/224
6,670,779 B2 * 12/2003 Shen ..... 315/291
7,170,235 B2 * 1/2007 Van Casteren ..... 315/224
7,391,165 B2 * 6/2008 Lee et al. ..... 315/247

* cited by examiner

*Primary Examiner*—Douglas W Owens
*Assistant Examiner*—Jimmy T Vu
(74) *Attorney, Agent, or Firm*—Scully, Scott, Murphy & Presser, P.C.

(57) ABSTRACT

A control circuit (1) for driving a gas discharge lamp, in particular a fluorescent lamp (FL), having a controllable converter (2) for converting a DC voltage to an AC voltage and having two feed lines (3, 4), which are connected on the AC-voltage side to the converter (2), and between which the gas discharge lamp can be connected, an inductor (L1), a first capacitance (C1) and a first controllable switching element (T1) being connected in series in the feed lines (3, 4). The feed lines (3, 4) are connected to one another via a second switching element (T2). A control unit (ST2) controls the switching elements (T1, T2, T3) in synchronism with the AC voltage of the converter (2) and is designed such that the second switching element (T2) is opened after a closed phase for the purpose of starting the gas discharge lamp at such a point in time that the AC voltage at the inductor (L1), which is set in the resonant circuit including the inductor (L1) and the parasitic capacitance (C4) of the second switching element (T2), and the AC voltage of the converter (2), approximately in-phase in terms of their extrema, are added to give a starting voltage. Furthermore, provided is a corresponding method for driving the gas discharge lamp.

13 Claims, 1 Drawing Sheet

CONTROL CIRCUIT AND METHOD FOR DRIVING A GAS DISCHARGE LAMP

BACKGROUND OF THE INVENTION

1. Field of the Invention

The invention relates to a control circuit for driving a gas discharge lamp, in particular a fluorescent lamp, having a controllable converter for converting a DC voltage to an AC voltage and having two feed lines, which are connected on the AC-voltage side to the converter, and between which the gas discharge lamp can be connected, an inductor, a first capacitance and a first controllable switching element being connected in series in the feed lines. The invention also relates to a method for driving a gas discharge lamp, in particular a fluorescent lamp, said lamp being driven for the purpose of producing different brightnesses with an AC voltage generated by a converter or with a DC voltage derived from the AC voltage via an inductor, a first capacitance and a controllable switching element, which are connected in series with the gas discharge lamp.

2. Discussion of the Prior Art

The use of an electronic ballast is known for starting and for operating a gas discharge lamp, in particular a fluorescent lamp, which is understood as being a gas discharge lamp which is coated on the inside with a fluorescent material. Such an electronic ballast comprises, in addition to a converter for converting a DC voltage to an AC voltage, an inductor and a capacitance, which are connected in series with the gas discharge lamp. The inductor and the capacitance form a series resonant circuit which is operated at resonance for starting purposes by means of the frequency of the AC voltage of the converter being adjusted. This results in a high voltage across the gas discharge lamp which ultimately allows the gas discharge lamp to restart. After starting, the impedance of the gas discharge lamp falls to its operational value, as a result of which an operating voltage is set at the lamp.

In order to dim the gas discharge lamp, the operating voltage can be influenced by means of a switchable switching element. This is possible, for example, by means of phase gating or by means of pulse width modulation. When the gas discharge lamp has been started, it can be operated both with an AC voltage and with a DC voltage.

In particular for applications in the aircraft industry, it is necessary for the control circuit to be light and cost-effective. In this regard, operation at operating frequencies which are as high as possible would be desirable since; as a result, the size of the inductor required can be reduced. A high operating frequency moreover provides the advantage of flicker-free operation of the gas discharge lamp. Brightness variations at a frequency of $\geqq 100$ Hz can no longer be resolved by the human eye.

In the case of the described operation of a gas discharge lamp with an electronic ballast, a certain size for the inductor is disadvantageously required, however, in order to still be able to generate the required starting voltage. In this case, the starting voltage even needs to be increased as the operating frequency increases since the gas discharge lamp has increasingly less time available for restarting as the operating frequency increases.

SUMMARY OF THE INVENTION

One object of the invention is to specify a control circuit for driving a gas discharge lamp which has a weight which is as low as possible and nevertheless allows for reliable starting. The control circuit should in particular also be suitable for controlling the brightness of the gas discharge lamp. Furthermore, it is an object of the invention to specify a corresponding method for driving a gas discharge lamp, which allows for reliable starting and makes it possible to produce different brightnesses for the gas discharge lamp with a control circuit which is as light as possible.

The first-mentioned object is achieved according to the invention by a control circuit in accordance with the precharacterizing clause of Patent Claim 1 by the fact that the feed lines between the inductor and the first capacitance are electrically connected via a second controllable switching element, the fact that the inductor and the first capacitance are bridged via a first diode, and the fact that a control unit, which is connected to the first switching element, to the second switching element and to the converter, is provided for the purpose of driving the switching elements in synchronism with the AC voltage of the converter and is designed such that the second switching element is opened after a closed phase for the purpose of starting the gas discharge lamp at such a point in time that the AC voltage at the inductor, which is set in the resonant circuit comprising the inductor and the parasitic capacitance of the second switching element, and the AC voltage of the converter, approximately in phase in terms of their extrema, are added to give a starting voltage.

In this case, it is irrelevant for the control circuit when considering the installation direction of the components used whether the AC voltage set in the resonant circuit and the AC voltage of the converter are added in terms of their negative phases, i.e. actually in terms of their minima, or in terms of their positive phases, i.e. actually in terms of their maxima. The control circuit can in principle be designed for both directions when the polarity is changed in a corresponding manner, in particular that of the diodes.

An inductor has an inductance and displays an impedance which increases as the frequency increases. Coils are known as components for this purpose. A diode is a defined component which blocks the current in one direction and allows it to pass through virtually unimpeded in the other direction. Semiconductor diodes or semiconductors appertaining to a higher logic can be used as the components. The capacitance can be formed by a capacitor.

In this case, the invention is based on the consideration of using a voltage source for starting the gas discharge lamp without generating any additional power loss. This is successful owing to the fact that the parasitic capacitance of a second controllable switching element is used for creating a resonant circuit with the inductor which is already provided in the feed line. For this purpose, the two feed lines are electrically connected via the second switching element between the inductor and the first capacitance. When the switching element is closed, an inductor current, which is shifted through $\pi/2$ with respect to the AC voltage of the converter, flows via the inductor. When the first switching element is open, the gas discharge lamp is decoupled from the converter. At the same time, the first capacitance is charged to the peak value of the AC voltage of the converter via the first diode, which bridges the inductor and the first capacitance.

If the second switching element is opened, the inductor ensures that the inductor current continues to flow in the same direction. The parasitic capacitance of the second switching element and the inductance of the inductor form a resonant circuit whose frequency is generally higher than the frequency of the converter. The inductor current and the voltage induced at the inductor now oscillate at the frequency of the resonant circuit. The output voltage of the converter, on the other hand, maintains the predetermined frequency. The inductor outputs the stored energy to the output circuit via the second diode. The voltage drop across the second switching element therefore results from an addition of the output voltage of the converter and the inductor voltage induced by the inductor current, which voltages oscillate at different frequencies. If the second switching element is opened at the correct point in time, it is possible to achieve a situation in which the extrema of the AC voltage at the inductor and the AC voltage of the converter coincide with one another. It is therefore possible, by means of selecting the correct opening time for the second switching element, to generate a starting voltage which can be approximately twice as high as the maximum of the output voltage of the converter. This effect is intensified further by the voltage at the first capacitance.

Since the inductor current lags the inductor voltage by $\pi/2$, an addition of the extrema of the AC voltage of the converter and the induced AC voltage at the inductor results approximately when the second switching element is opened in the negative, or in the case of a correspondingly opposite polarity of the control circuit in the positive, maximum of the inductor current. In this case, the two voltages are added up in the correct phase sequence approximately in terms of the extremum of the AC voltage of the converter. The frequency of the resonant circuit is ideally twice as high as the frequency of the AC voltage of the converter.

In order to open the second switching element at the correct point in time, it is necessary to drive the second switching element in synchronism with the frequency of the AC voltage of the converter.

Advantageously, a second diode is connected in between the first capacitance and the first switching element, and a second capacitance is connected in between the second diode and the first switching element, which second capacitance connects the connecting lines.

When the second switching element is closed, the second diode with the blocking direction in the same direction as the first diode means that the second capacitance is likewise charged to the maximum of the AC voltage of the converter via the first diode. If the first capacitance is a multiple greater than the second capacitance, the voltage at the second capacitance results from the addition of the voltage present at the second switching element and the voltage at the first capacitance. The highest voltage for starting the lamp is therefore available at the second capacitance. When the first switching element is open, the gas discharge lamp is completely decoupled from the converter owing to the first and second diodes. The energy for the starting operation comes exclusively from the second capacitance. The highest voltage results when the frequency of the resonant circuit is approximately twice as high as the frequency of the AC voltage of the converter.

The described use of the second capacitance makes it possible for energy for the gas discharge lamp to be provided in a controlled manner independently of the converter. Suitable control of the first switching element makes it possible to make available the stored energy of the gas discharge lamp over a relatively long period of time. This allows for a further reduction in the starting voltage required for starting, with the result that at higher-frequency AC voltages, it is also possible to work with a small inductor.

In one further advantageous refinement of the invention, the second diode and the first switching element are bridged via a third controllable switching element, which is connected to the control unit, the control unit being designed both for DC operation of the gas discharge lamp, in particular at a low brightness, when the third switching element is open by means of driving the first switching element and also for AC operation of the gas discharge lamp, in particular at a high brightness, when the first switching element is open by means of driving the third switching element.

If the second diode and the first switching element are bridged via a third controllable switching element which is connected to the control unit, after starting of the gas discharge lamp conventional operation with the AC voltage of the converter is possible. In this case, the brightness is adjusted by means of correspondingly driving the third switching element. Surprisingly, it has advantageously been shown that operation of the gas discharge lamp is possible with direct current in a low brightness range without resulting in so-called cataphoresis, i.e. in migration of light to one side of the gas discharge lamp. If the DC voltage is fed in a clocked manner, for example by means of pulse width modulation, to the gas discharge lamp, such a DC voltage supply is possible up to a brightness of the gas discharge lamp of approximately 3% of the maximum achievable brightness. Above this brightness range, it is necessary to switch over to AC voltage operation owing to the cataphoresis.

In one expedient refinement of the invention, the control unit is provided for keeping the first and the third switching elements open and the second switching element closed in a first phase, for opening the second switching element for starting purposes in the correct phase sequence in a second phase, for closing the second switching element and the first switching element in a third phase, and either for controlling the first switching element when the third switching element is open for DC operation of the gas discharge lamp or for controlling the third switching element when the first switching element is open for AC operation of the gas discharge lamp in a fourth phase.

In the first phase, no current flows via the gas discharge lamp. The gas discharge lamp is decoupled from the converter. The first and the second capacitances are charged via first and second diodes. An inductor current flows via the inductor and the second switching element.

In the second phase, the second switching element is opened in the correct phase sequence with the AC voltage of the converter by means of the control unit, with the result that the inductor voltage and the output voltage of the converter are added virtually in terms of their extrema to give a total voltage. The voltages of the capacitances are added to this. A high starting voltage is present at the second capacitance.

In the third phase, the second and the first switching elements are closed. The second diode is blocked. The gas discharge lamp is decoupled from the converter. The energy for the starting operation comes exclusively from the second capacitance. The decoupling of the converter and the high voltage applied to the second capacitance guarantee soft and flicker-free starting of the gas discharge lamp given corresponding control of the first switching element. In this case, it is advantageous if the first switching element is in the form of a current limiter, with the result that the transition of the gas discharge lamp from a capacitance to a resistive load is compensated for.

Finally, in the fourth phase, either the first switching element is controlled when the third switching element is open for DC operation of the gas discharge lamp or the third switching element is controlled when the first switching element is open for AC operation of the gas discharge lamp. In the former case, the direct current of the gas discharge lamp flows via the first diode and the first switching element. In the second case, the alternating current flows via the third switching element, the inductor, the first capacitance and the third capacitance.

In order to regulate the brightness of the gas discharge lamp, it is advantageous if the control unit is designed for controlling the switching elements, which apply voltage to the gas discharge lamp, by means of pulse width modulation. In particular, this technique makes it possible to control the gas discharge lamp in a low brightness range by means of providing a DC voltage in a clocked manner and in a high brightness range by providing an AC voltage in a clocked manner. The pulse width modulation in this case provides the advantage of flicker-free operation. Since the gas discharge lamp itself does not require high frequencies for its operation, the pulse width modulation can be carried out at a high operating frequency of the converter at a comparatively lower clock frequency. This procedure makes it possible to leave the lamp sufficient time for starting. Advantageously, the four phases described are executed in each clock cycle of the pulse width modulation. It can be seen that the switching elements provided for the pulse width modulation need to be operated in synchronism with the AC voltage of the converter. The starting time needs to be in the correct phase sequence in order to achieve the required starting voltage.

Driving of a gas discharge lamp by means of pulse width modulation, in which case the gas discharge lamp is operated in a low brightness range with a clocked DC voltage and in a high brightness range with a clocked AC voltage, as such is an invention in its own right which can advantageously be combined with the other features mentioned. Owing to the use of pulse width modulation for the clocked provision of a DC voltage, DC voltage operation of a gas discharge lamp is possible without the occurrence of cataphoresis up to a brightness of 3%, in particular up to a brightness of 1.5%. If a brightness above this limit is intended to be driven, the gas discharge lamp is operated by means of pulse width modulation with a clocked AC voltage.

Since the gas discharge lamp is restarted in each clock cycle of the pulse width modulation, the frequency of the pulse width modulation can expediently be selected to be greater than 100 Hz.

For reasons of electromagnetic compatibility (EMC), which is of significant importance in particular for an application of the control circuit in the aircraft industry, the control unit is advantageously designed to control the switch-on duration of the switching elements in a clock cycle of the pulse width modulation in each case as an integral multiple of the period of oscillation of the AC voltage of the converter. If the gas discharge lamp is operated with a clocked AC voltage, this is AC operation, whole oscillations being blanked out in order to realize dimming. The pulse width modulation is modified to give pulse packet modulation, whole oscillation packets of the AC voltage of the converter always being switched. In order to achieve a degree of electromagnetic compatibility which is as high as possible and as little power loss as possible, the pulse packets are switched at the zero crossing.

For reasons of EMC, the frequency of the AC voltage of the converter cannot be as high as desired. A range of between 20 and 60 kHz has proven to be practicable. As a result, the resolution of the dimming is physically limited in the case of pulse packet modulation since only whole oscillations can be switched.

The lowermost dimming stage for a gas discharge lamp driven in such a manner would be a whole oscillation of the AC voltage of the converter in the clock cycle of the pulse width modulation. At a frequency of the AC voltage of the converter of 40 kHz and a clock frequency of the pulse width modulation of 100 Hz connection would therefore take place every 400th oscillation. This corresponds to a theoretically possible lowermost dimming stage with a brightness of 0.25% of the maximum possible brightness of the gas discharge lamp. However, a plurality of connected oscillations is required for stable operation. In addition, the starting operations which are likewise repeated at the clock frequency also entail a certain light phenomenon after the blanking. The lowermost dimming stage which can be set during AC operation is therefore approximately 1.5% of the maximum possible brightness.

If pulse packet control is used during AC operation for driving the gas discharge lamp, the resolution of the individual dimming stages is determined by the duration of a period of oscillation of the AC voltage of the converter and by the clock frequency of the pulse width modulation. In the described example with a clock frequency of 100 Hz and a frequency of the AC voltage of the converter of 40 kHz, the smallest resolution of the dimming stages is therefore 0.25% of the maximum achievable brightness. In order to allow for the dimming to appear continuous, it is advantageous if the control unit is designed to control, in a clock cycle of the pulse width modulation after execution of the control of the third switching element, as a result of which AC voltage is applied to the gas discharge lamp, the first switching element when the third switching element is open, as a result of which a DC voltage is applied to the gas discharge lamp.

This makes it possible to allow the brightness graduation to appear virtually continuous by adding a proportion with DC voltage or DC operation in a clock cycle with the pulse width modulation. This is particularly successful if, after the end of the application of AC voltage, the DC voltage application takes place with such a duration that overall a brightness nuance between two dimming stages resulting only with AC voltage operation is formed. As a result, the dimming stages can be transferred to one another by adapting the duration of the DC voltage operation.

The second-mentioned object of the invention is achieved according to the invention for a method in accordance with the precharacterizing clause of Patent Claim 9 by the fact that, for starting purposes, a second controllable switching element, which forms, with its parasitic capacitance, a resonant circuit with the inductor, is opened after a closed phase at such a point in time that the AC voltage at the inductor, which is set in the resonant circuit and the AC voltage of the converter, approximately in phase in terms of their extrema, are added to give a starting voltage. The advantages mentioned for a control circuit can be applied accordingly to claims directed at the method for driving.

BRIEF DESCRIPTION OF THE DRAWING

One exemplary embodiment of the invention will be explained in more detail with reference to a drawing, in which.

DETAILED DESCRIPTION OF THE INVENTION

Figure 1:
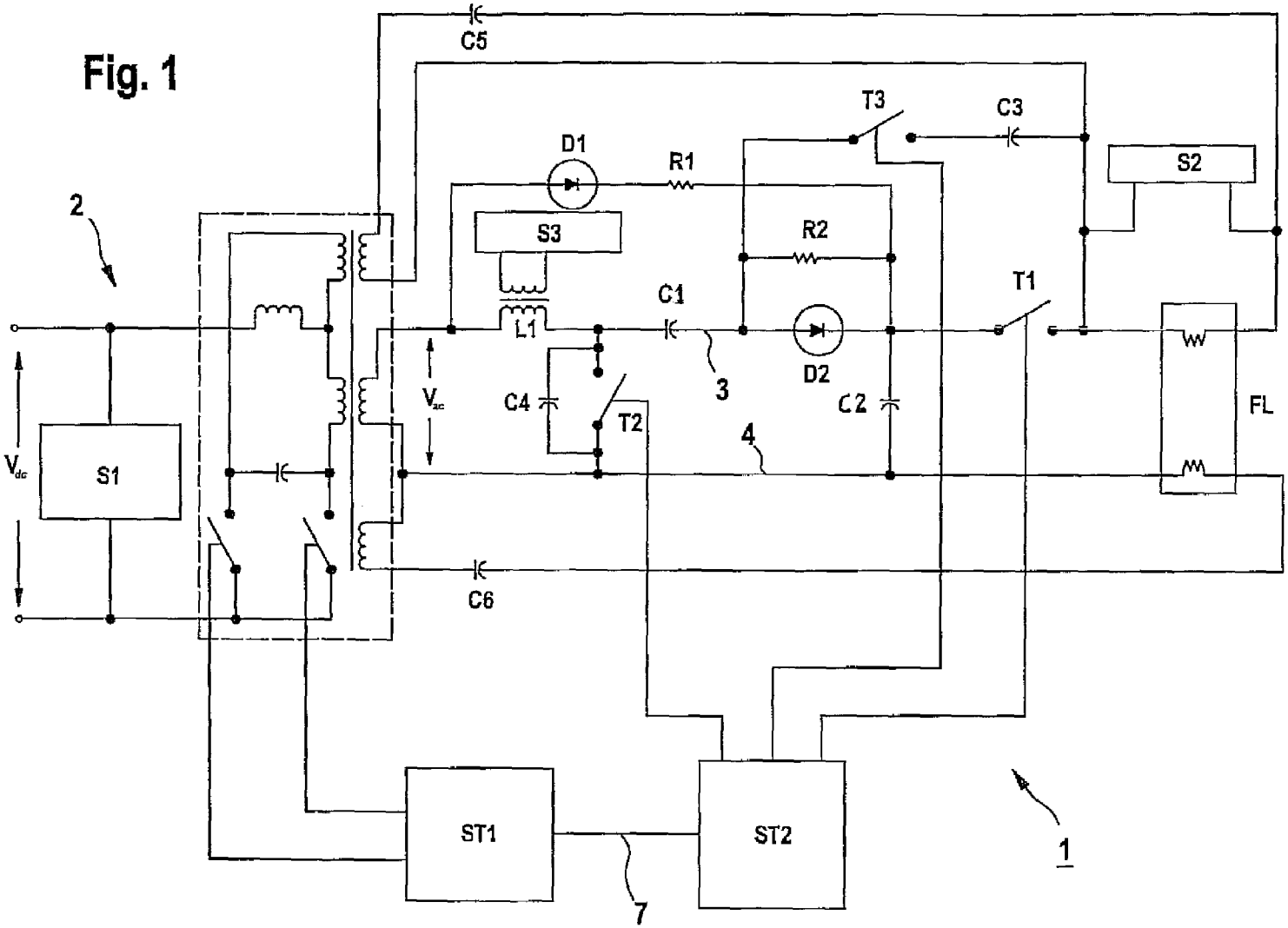
FIG. 1 shows a control circuit for brightness-variable driving of a fluorescent lamp.

The circuit arrangement 1 shown in FIG. 1 comprises, as the essential components, a converter 2, which is in the form of a Royer converter, and to which a fluorescent lamp FL is connected on the AC-voltage side between the feed lines 3 and 4. An inductor L1, a first capacitance C1 and a first controllable switching element T1 are located in the feed line 3. This basic circuit corresponds to an electronic ballast of the conventional type.

The converter 2 in the form of a Royer converter produces an AC voltage Vac applied to the feed lines 3 and 4 from a DC voltage Vdc. The frequency of this AC voltage Vac is 40 kHz.

The further outputs of the converter 2 are used, via the capacitances C5 and C6, to preheat the filaments of the fluorescent lamp FL.

The feed lines 3 and 4 can be connected between the inductor L1 and the first capacitance C1 via a second controllable switching element T2. The switching element T2, in the open position, has a parasitic capacitance which is represented by the fourth capacitance C4 which is connected in parallel. The inductor L1 and the first capacitance C1 are bridged by means of a first diode D1. A second diode D2 is connected in, in series, between the first capacitance C1 and the first switching element T1. The connecting lines 3 and 4 are connected to one another via a second capacitance C2 between the second diode D2 and the first switching element T1. The second diode D2 and the first switching element T1 are bridged via a third capacitance C3 by a third switching element T3 connected in series. In order to achieve corresponding charge currents at the first and the second capacitances C1 and C2, the resistors R1 and R2, respectively, are provided.

In order to operate the circuit arrangement 1, the converter 2 in the form of a Royer converter is clocked by means of a controller ST1. The switching elements T1, T2 and T3 are connected to a control unit ST2, which is connected to the controller ST1 via a synchronization line 7. The driving of the switching elements T1, T2 and T3 is derived from the clock cycle of the controller ST1 for the converter 2.

In a first phase, the second switching element T2 is closed. The first and the third switching elements T1, T3 are open. The fluorescent lamp FL is therefore completely decoupled from the converter 2; no current flows via said lamp. The first and the second capacitances C1 and C2 are charged to the peak value of the AC voltage Vac of the converter 2 via the first diode D1 and the resistors R1 and R2. At the same time, an inductor current at the frequency of the converter 2 flows through the inductor L1. The energies stored in the first capacitance C1 and in the inductor L1 are used later for generating the starting energy.

In a second phase, the provision of the starting energy takes place by means of charging the second capacitance C2. For this purpose, the second switching element T2 is opened in order to achieve an induced voltage at the inductor L1 which is as high as possible. For this purpose, the second switching element T2 is opened at a negative maximum of the inductor current. The inductor L1 ensures that the inductor current continues to flow in the same direction. The parasitic capacitance C4 of the second switching element T2 and the inductance of the inductor L1 form a resonant circuit, whose frequency is higher than the frequency of the AC voltage of the converter 2. The inductor current and the voltage induced at the inductor L1 now oscillate at the frequency of the resonant circuit. The AC voltage Vac of the converter 2 maintains its frequency. The inductor L1 outputs the stored energy to the output circuit. A voltage is produced at the second switching element T2 which results from an addition of the voltages Vac and the inductor voltage, which voltages oscillate at different frequencies, however. The second switching element T2 is opened such that approximately the maxima of the voltages Vac and the inductor voltage coincide with one another. The best opening time is at the negative maximum of the inductor current. The dimensions of the components used in the circuit arrangement 1 shown are selected such that the frequency of the resonant circuit comprising the inductor L1 and the parasitic capacitance C4 is approximately twice as high as the frequency of the AC voltage of the converter 2. This results in a high voltage at the second switching element T2. The first capacitance C1 is selected to be many times greater than the second capacitance C2, as a result of which the voltage at the second capacitance C2 results from the addition of the voltage at the second switching element T2 and the voltage at the first capacitance C1. At the end of this phase, a high voltage is available at the second capacitance C2 for starting the fluorescent lamp. As before, no current flows via the fluorescent lamp FL.

In a third phase, the second switching element T2 and the first switching element T1 are closed. The third switching element T3 remains open. The second diode D2 is blocked with the blocking direction illustrated. The converter 2 is decoupled from the fluorescent lamp FL.

The energy stored at the second capacitance C2 can therefore be made available to the fluorescent lamp FL for the duration required for starting irrespective of the frequency of the AC voltage of the converter 2. The circuit arrangement 1 therefore makes it possible to generate a sufficient starting voltage with a small inductor and a high operating frequency. Owing to the decoupling, the converter 2 is also unaffected by the effects in the circuit arrangement 1, with the result that the frequency of the AC voltage generated remains substantially constant.

By closing the first switching element T1, after a certain duration the fluorescent lamp FL is started as a result of the high voltage at the second capacitance C2. In order to achieve soft and flicker-free starting of the fluorescent lamp FL, the first switching element T1 is in the form of a dynamic current source. The dynamic current source is, for example, a variable resistor, which ensures that the current flowing through the fluorescent lamp FL is limited independently of its transition from a capacitance prior to starting to a resistive load after starting. After starting of the fluorescent lamp FL, a controlled direct current flows through the fluorescent lamp FL via the first diode D1.

If a brightness of the fluorescent lamp FL of less than 1.5% is desired, the fluorescent lamp FL continues to be supplied with DC voltage via the first switching element T1 after starting. In this case, the energy passes via the first diode D1 and the resistor R1 to the fluorescent lamp FL. Regulation of the brightness takes place by means of pulse width modulation by driving the first switching element T1. The DC voltage is made available by the switching element T1 in a clocked manner by means of the control unit ST2 such that the desired brightness is set at the fluorescent lamp FL.

If a brightness of about 1.5% is desired, the first switching element T1 is opened in order to avoid the increasing losses. The second switching element T2 is opened in order that the inductor current can pass via the first capacitance C1 and the third capacitance C3 to the fluorescent lamp FL. Correspondingly, the third switching element T3 is actuated by the control unit. The desired brightness is in turn set by means of pulse width modulation of the AC voltage of the converter 2 which is made available via the third switching element T3. The fluorescent lamp FL now functions in the AC operating mode. The third capacitor C3 ensures that no direct current flows via the third switching element T3.

The control unit ST2 of the circuit arrangement 1 shown controls the first and the third switching elements T1 and T3 for the pulse width modulation of the corresponding voltages. In each clock cycle of the pulse width modulation, a starting voltage is built up at the second capacitance C2 by opening the second switching element T2 in the correct phase sequence, said starting voltage being applied to the fluorescent lamp FL by the first switching element T1 being opened. Then, in the clock cycle of the pulse width modulation, either DC operation brought about by clocking of a DC voltage takes place at a brightness of less than 1.5% of the overall achievable brightness or else AC operation of the fluorescent lamp FL resulting by clocking of the AC voltage of the converter 2 takes place at a desired brightness above 1.5%. With the interaction of the switching elements T1, T2 and T3, a further dimming range of the fluorescent lamp FL is achieved between 0.1 and 100% of the maximum achievable brightness.

If the fluorescent lamp FL is operated in the upper brightness range during AC operation, this takes place by means of pulse packet control. This increases the electromagnetic compatibility and makes flicker-free operation possible. The clock frequency of the pulse packet control is 100 Hz. The third switching element T3 is in this case operated such that only integral multiples of the oscillations of the AC voltage of the converter 2 are always contained. The switch-on time takes place exclusively during a zero crossing of the AC voltage of the converter 2. This is expedient for achieving good electromagnetic compatibility.

The graduation of the dimming resulting from the pulse packet control (the smallest resolution corresponds to the ratio of the clock frequency of the pulse width modulation to the frequency of the AC voltage of the converter 2) is resolved by adding a DC voltage operation of the fluorescent lamp FL within a clock cycle after termination of the AC operation with a variable duration. As a result, a brightness nuance between two dimming stages is possible during AC operation.

List of Reference Symbols
1 Circuit arrangement
2 Converter
3 Feed line
4 Feed line
7 Synchronization line
C1 First capacitance
C2 Second capacitance
C3 Third capacitance
C4 Parasitic (fourth) capacitance
C5 Fifth capacitance
C6 Sixth capacitance
D1 First diode
D2 Second diode
FL Fluorescent lamp
L1 Inductor
R1 First resistor
R2 Second resistor
S1 Supply T2, ST1 and ST2
S2 Supply T1
S3 Supply T3
ST1 Controller converter
ST2 Control unit
T1 First switching element
T2 Second switching element
T3 Third switching element
Vdc DC supply voltage
Vac AC voltage converter

What is claimed is:

1. A control circuit for driving a gas discharge lamp, in particular a fluorescent lamp (FL), including a controllable converter (2) for converting a DC voltage to an AC voltage and having two feed lines (3, 4) which are connected on the AC-voltage side to the converter (2), and between which feed lines the gas discharge lamp is connectable, an inductor (L1), a first capacitance (C1) and a first controllable switching element (T1) being connected in series in the feed lines (3, 4), wherein the feed lines between the inductor (L1) and the first capacitance (C1) are electrically connected via a second controllable switching element (T2), the inductor (L1) and the first capacitance (C1) being bridged via a first diode (D1), and including a control unit (ST2) which is connected to the first switching element (T1), to the second switching element (T2) and to the converter (2), and which is provided for driving the switching elements (T1, T2) in synchronism with the AC voltage of the converter (2) and is designed such that the second switching element (T2) is opened after a closed phase for starting the gas discharge lamp at such a point in time that the AC voltage at the inductor (L1), which is set in the resonant circuit comprising the inductor (L1) and the parasitic capacitance (C4) of the second switching element (T2), and the AC voltage of the converter (2), approximately in phase in terms of their extrema, are added to provide a starting voltage.

2. A control circuit according to claim 1, wherein a second diode (D2) is connected between the first capacitance (C1) and the first switching element (T1), and a second capacitance (C2) is connected between the second diode (D2) and the first switching element (T1), said second capacitance (C2) connecting the connecting lines (3, 4).

3. A control circuit according to claim 2, wherein the second diode (D2) and the first switching element (T1) are bridged via a third controllable switching element (T3) which is connected to the control unit (ST2), and wherein the control unit (ST2) is designed both for DC operation of the gas discharge lamp, in particular at a low brightness, when the third switching element (T3) is open by means of driving the first switching element (T1) and also for AC operation of the gas discharge lamp, in particular at a high brightness, when the first switching element (T1) is open by the driving of the third switching element (T3).

4. A control circuit according to claim 2, wherein the control unit (ST2) is provided for maintaining open the first and the third switching elements (T1, T3) and the second switching element (T2) closed in a first phase, for opening the second switching element (T2) for starting purposes in the correct phase sequence in a second phase, for closing the second switching element (T2) and the first switching element (T1) in a third phase, and either for controlling the first switching element (T1) when the third switching element (T3) is open for DC operation of the gas discharge lamp or for controlling the third switching element (T3) when the first switching element (T1) is open for AC operation of the gas discharge lamp in a fourth phase.

5. A control circuit according to claim 4, wherein the control unit (ST2) is designed for controlling the switching elements (T1, T3), which apply voltage to the gas discharge lamp, through pulse width modulation.

6. A control circuit according to claim 5, wherein the control unit (ST2) is designed to control the switch-on duration of the switching elements (T1, T3) in a clock cycle of the pulse width modulation in each case as an integral multiple of the period of oscillation of the AC voltage of the converter (2).

7. A control circuit according to claim 6, wherein the control unit (ST2) is designed to control the switch-on time of the switching elements (T1, T3) in a clock cycle in each case in synchronism with a zero crossing of the oscillation of the AC voltage of the converter (2).

8. A control circuit according to claim 7, wherein the control unit (ST2) is designed to control, in a clock cycle of the pulse width modulation after execution of the control of the third switching element (T3), as a result of which AC voltage is applied to the gas discharge lamp, the first switching element (T1) when the third switching element (T3) is open, as a result of which a DC voltage is applied to the gas discharge lamp.

9. A method for driving a gas discharge lamp, in particular a fluorescent lamp (FL), said lamp being driven for the purpose of producing different brightnesses with an AC voltage generated by a converter (2) or with a DC voltage derived from the AC voltage via an inductor (L1), a first capacitance (C1) and a first controllable switching element (T1), which are connected in series with the gas discharge lamp, wherein for starting purposes, a second controllable switching element (T2), which forms, with its parasitic capacitance (C4), a resonant circuit with the inductor (L1), is opened after a closed phase at such a point in time that the AC voltage at the inductor (L1), which is set in the resonant circuit and the AC voltage of the converter (2), approximately in phase in terms of their extrema, are added to give a starting voltage.

10. A method according to claim 9, wherein after starting, the gas discharge lamp is driven in a pulse-width-modulated manner by the DC voltage for the purpose of achieving a low brightness or by the AC voltage for the purpose of achieving a high brightness.

11. A method according to claim 10, wherein application of voltage to the gas discharge lamp in a clock cycle of the pulse width modulation in each case has a duration which corresponds to an integral multiple of the period of oscillation of the AC voltage of the converter (2).

12. A method according to claim 11, wherein the point in time at which the application of voltage to the gas discharge lamp starts is in each case in synchronism with a zero crossing of the oscillation of the AC voltage of the converter (2).

13. A method according to claim 10, wherein a DC voltage is applied to the gas discharge lamp in a clock cycle of the pulse width modulation after execution of the application of AC voltage.

* * * * *